United States Patent [19]

Gongwer

[11] 4,178,128

[45] Dec. 11, 1979

[54] METHOD OF AND DEVICE FOR PROPULSION

[75] Inventor: Calvin A. Gongwer, Glendora, Calif.

[73] Assignee: Innerspace Corporation, Glendale, Calif.

[21] Appl. No.: 795,384

[22] Filed: May 10, 1977

[51] Int. Cl.[2] ..... A63C 31/10

[52] U.S. Cl. ..... 416/72; 9/304; 416/82

[58] Field of Search ..... 416/82, 83, 72, 70 R, 416/73, 69, 79, 81, 1; 9/303, 304, 305, 309

[56] References Cited

U.S. PATENT DOCUMENTS

| | | | |
|---|---|---|---|
| 35,451 | 6/1862 | Johnson | 416/81 |
| 107,376 | 9/1870 | Hunter | 416/81 |
| 233,209 | 10/1880 | Coulter | 416/83 |
| 2,094,532 | 9/1937 | Glad | 9/305 |
| 2,343,468 | 3/1944 | Messinger | 9/304 |
| 3,084,355 | 4/1963 | Ciccotelli | 9/304 |
| 3,215,371 | 11/1965 | Schmidt | 416/83 |
| 3,405,413 | 10/1968 | Manis | 9/309 |
| 3,665,535 | 5/1972 | Picken | 9/304 |
| 3,802,008 | 4/1974 | Gongwer | 9/303 X |

FOREIGN PATENT DOCUMENTS

| | | | |
|---|---|---|---|
| 311416 | 5/1919 | Fed. Rep. of Germany | 416/81 |
| 477143 | 1/1914 | France | 416/83 |

*Primary Examiner*—Everette A. Powell, Jr.
*Attorney, Agent, or Firm*—Lyon & Lyon

[57] ABSTRACT

A propulsion device and its method of use, the device having a forward foil and a rearward foil adapted for alternate transverse reciprocal and alternate pivotal movement in opposed direction about parallel axes. The forward and rearward foil axes are perpendicular to the chords of the forward and rearward foils and the rearward foil is positioned to the rear of, and in a nested relationship with, the forward foil. The axes of the forward and rearward foils are positioned a distance of less than one-quarter of the chord length from the leading edge of the forward and rearward foils, respectively.

10 Claims, 7 Drawing Figures

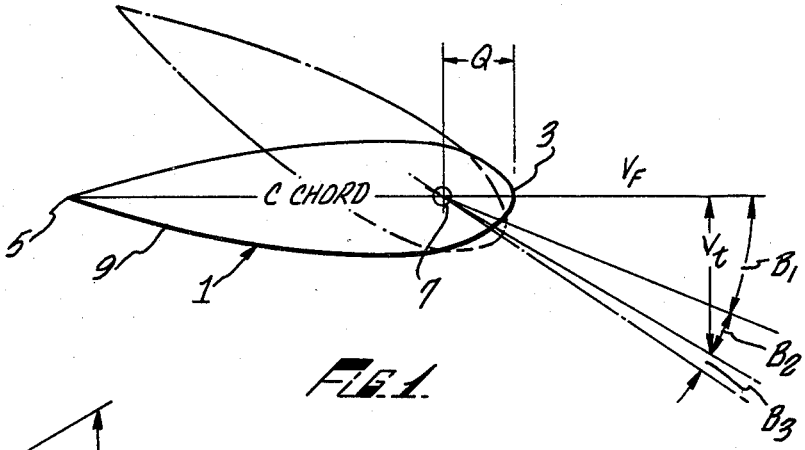
FIG. 1
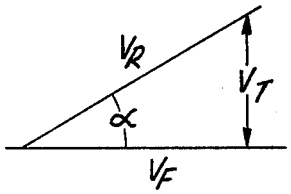
FIG. 2
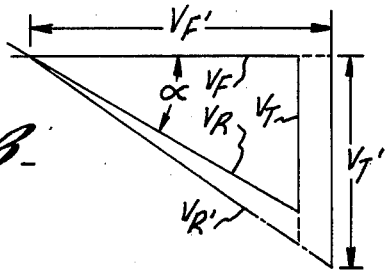
FIG. 3
FIG. 4
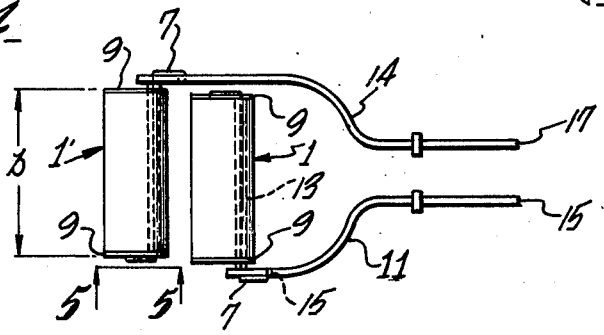
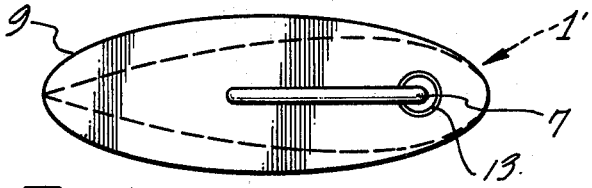
FIG. 5
FIG. 7
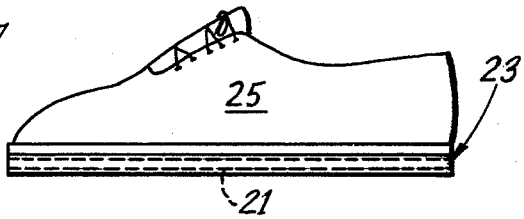
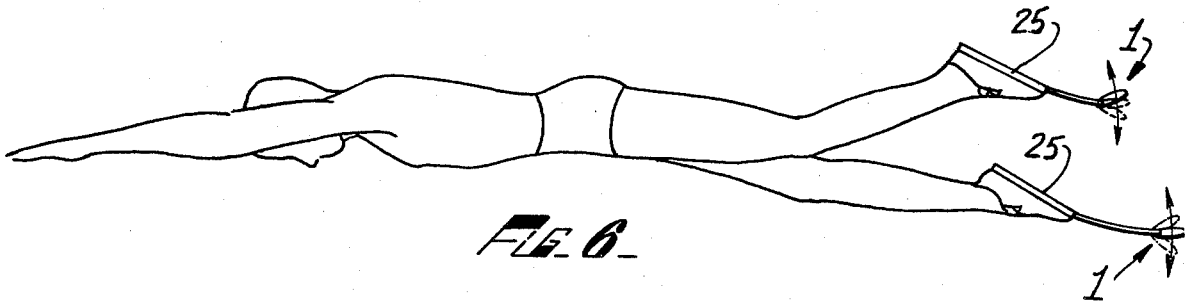
FIG. 6

METHOD OF AND DEVICE FOR PROPULSION

BACKGROUND OF THE INVENTION

1. Field of the Invention

This invention relates to a propulsion device and its method of use. More particularly, this invention relates to two or more foils which are positioned such that the wake produced by alternate transverse motion, and by the pivoting of the foils about a point less than the quarter chord distance of the foil from the leading edge, produces increased resultant velocity and forward thrust. In one embodiment the device is utilized as an improved swim fin. In an alternate embodiment the device may be motor driven and used to propel a ship or other large body.

2. Description of the Prior Art

It is known to utilize foils or blades in order to produce a propulsion device. See, for example, my U.S. Pat. Nos. 3,204,699, 3,122,759 and 3,204,262. While the devices of the foregoing patents are extremely successful in producing propulsion through a fluid medium, the devices produce a wash or wake whose momentum and energy are not fully utilized to produce a forward thrust.

It is an object of this invention to provide an improved propulsion device and method of operation. Other and additional objectives will become apparent upon a reading of the entire specification, including the drawings and claims.

SUMMARY OF THE INVENTION

This invention relates to a fluid propeller having a forward foil means and a rearward foil means in nested relationship for alternate transverse reciprocal and alternate pivotal movement in opposed direction about substantially parallel axes. The wake of the forward foil means increases the resultant velocity component and the forward thrust produced by the rearward foil means and the action of the rearward foil means increases the resultant velocity component and the forward thrust produced by the forward thrust means. The forward and rearward foil means axes are preferably substantially perpendicular to the chords of the forward and rearward foil means and the rearward foil means is preferably positioned to the rear of the forward foil means. The axes of the forward and rearward foil means about which the forward and rearward foil means pivot are preferably positioned a distance of less than about one-quarter of the chord length from the leading edge of the forward and rearward foil means, respectively.

BRIEF DESCRIPTION OF THE DRAWINGS

FIG. 1 is a partial cross-sectional view of this invention.

FIGS. 2 and 3 are velocity diagrams illustrating this invention.

FIG. 4 is a top view of an embodiment of this invention.

FIG. 5 is a partial front view of this invention.

FIGS. 6 and 7 are pictorial views illustrating this invention.

DESCRIPTION OF THE PREFERRED EMBODIMENTS

Referring now to Applicant's drawing, and specifically referring to FIG. 1, a foil 1 is shown having a foil outer surface 9, a leading edge 3 and a trailing edge 5.

The foil 1 is allowed to pivot about pivot 7 which is located a distance Q along the chord line from the leading edge 3 to the trailing edge 5. The length Q is less than one-quarter of the total chord length C. It has been determined that the pressure lift force exerted on a foil acts about the foil quarter chord point that is about a point approximately one-quarter of the chord length from the leading edge. A pivot 7 ahead of this quarter chord point allows the foils to automatically feather as will be discussed in detail later in this specification. The interior of the foil 1 may be filled with flotation material 11. The foils 1 and 1' preferably have a profile which is convex throughout the periphery of the foil outer surface 9.

FIG. 2 illustrates a velocity triangle showing the velocity imparted by the foil 1. The velocity in the forward direction is labeled $V_F$, the transverse velocity component is labeled $V_T$ and the resultant or relative velocity is labeled $V_R$.

Such a velocity triangle is also illustrated in FIG. 1 wherein the foil is shown as dotted in its upward movement. $\beta_2$ is the angle of attack of the foil 1, that is the angle between the mean chord line and the relative velocity component. This angle is optimumly 3°–8° and is in part determined by the torsional loading of a spring 13 which is positioned adjacent to the pivot 7 and will be discussed later in the disclosure of this invention.

The effect of the backwash of the opposed fin is illustrated in FIG. 3 and in FIG. 1 where reference is made to the angle $\beta_3$. In the preferred embodiment as illustrated in FIG. 4 at least two foils are utilized, one being positioned rearward to the other, the foils 1 pivoting in alternate and opposed direction. As shown in FIG. 3, the backwash of the opposed foil produces an increased relative tangential velocity labeled $V_T'$, an increased relative velocity in the forward direction $V_F'$ and an increased relative resultant velocity $V_R'$.

The force acting upon the blade perpendicular to the chord line and having a horizontal component propelling it in the forward direction may be defined in accordance with the following formula:

F=(area of fin)(lift coefficient)(dynamic pressure)

The lift coefficient is a term which is closely related to the angle of attack while the dynamic pressure is equal to $\frac{1}{2}\rho(V_R)^2$, where $\rho$ is the density of the fluid.

As illustrated in FIG. 3, the backwash effect of the opposed fin produces an increase in the relative velocity from a magnitude of $V_R$ to a magnitude of $V_R'$ and further produces an increase in the forward velocity component from $V_F$ to $V_F'$. Making reference to the foregoing formula, the force acting upon the fin is increased. This effect can be described as the forward and rearward foils having a beneficial interference with each other.

FIG. 4 illustrates the span b of the foils 1 and 1'. The nesting configuration illustrated in FIG. 4 allows for an increased efficiency of the foils by decreasing the span loading which is a relationship of total force to span. The nesting configuration shown in FIG. 4 allows the center line of the device to be centered on the body (not shown) to be moved forward through a fluid medium thereby reducing the rolling movements of such a body.

Spring 13 may be locked within a frame 11 at detent 15 thereby restricting the movement of the foil in both clockwise and counter-clockwise pivotal rotational movement about pivot 7. As shown in FIGS. 4 and 5 an end plate 9 may be positioned about each end of the foils 1 and 1', respectively, in order to further increase the effective span b. In one embodiment of this invention, the reciprocating frame is operated by a suitable drive such as an engine. Alternately, the device may be mounted to the legs of a primate, one leg mounted to a first frame member 11 attached to foil 1 and the other mounted to a second frame member 14 attached to foil 1' and utilized as a water propulsion means. The second frame member 14 is preferably longer than first frame member 11 in order to provide the nested configuration illustrated in FIG. 4. Torsional spring means 13 in the rearward foil 1' is weaker than the spring means 13 in the forward foil in order to balance the force produced by the two foils and take into account the longer level arm produced by the length of first frame member 11. In one embodiment of this invention the forward portions 15 and 17 of first and second frame members are adapted to be positioned within a slot 21 of a solid member 23 adjacent to a shoe means 25. When leaving the water the frames 11 and 13 with attached foils 1 and 1' may be removed while the wearer retains the shoe means in order to protect his feet.

It will be recognized that modifications may be made within the scope of this invention, and this invention is not to be restricted to the preferred embodiment illustrated but is to be limited only by the scope of the appending claims.

What is claimed is:

1. A propulsion device comprising:

a forward foil means and a rearward foil means in nested relationship for alternate transverse reciprocal and alternate pivotal movement in opposed direction about substantially parallel pivot axes;

said forward and rearward foil means axes being substantially parallel to the leading edges of said forward and rearward foil means; and said axes of said forward and rearward foil means about which said forward and rearward foil means pivot being positioned a distance of less than about one-quarter of the chord length from the leading edge of said forward and rearward foils means;

whereby the wake of the forward foil means increases the resultant velocity component and the forward thrust produced by said rearward foil means and the action of the rearward foil means increases the resultant velocity component and the forward thrust means produced by said forward foil means.

2. The propulsion device claimed in claim 1 wherein said axes about which said forward and rearward foil means pivot are provided with biasing means which restrict and oppose pivoting movement from a neutral position of said forward and rearward foil means.

3. The propulsion device claimed in claim 2 wherein said device is further defined as including a reciprocal frame having pivots mounted thereto in order to allow for said alternate pivotal movement in opposed direction of said forward foil means and said rearward foil means.

4. The propulsion device claimed in claim 3 wherein said reciprocable means is further defined as having first and second frame members, said first frame member being pivotally mounted to said forward foil means and said second frame member being pivotally mounted to said rearward foil means whereby said first and second frame members may be alternately reciprocated in order to provide for said alternate pivotal movement in opposed direction of said forward foil means and said rearward foil means.

5. A propulsion device comprising:

first and second reciprocable frame members;

a forward foil means and a rearward foil means pivotally mounted to said first and second frame members respectively for alternate transverse reciprocal and alternate pivotal movement in opposed direction about substantially parallel axes;

said forward and rearward foil means axes being substantially perpendicular to the chords of said forward and rearward foil means;

said rearward foil means being positioned to the rear of said forward foil means and the mid-span points of said forward and rearward foil means are substantially aligned in a plane perpendicular to the leading edges of said forward and rearward foil means thereby providing a nesting forward and rearward foil means configuration; and said axes of said forward and rearward foil means about which said forward and rearward foil means pivot being positioned a distance of less than about one-quarter of the chord length from the leading edge of said forward and rearward foil means;

whereby the wake of the forward foil means increases the resultant velocity component and the forward thrust produced by said rearward foil means and the wake of the rearward foil means increases the resultant velocity component and the forward thrust means produced by said forward foil means.

6. The propulsion device claimed in claim 5 wherein said first and second reciprocal frame members each include a forward portion to be constrained to slotted shoe means attached to opposed legs of a primate body.

7. The propulsion device claimed in claim 5 wherein said pivotal mounting of said forward and rearward foil means to said first and second reciprocal frame members, respectively, is further defined as including a torsional spring biasing means for resisting pivotal movement from a neutral parallel axis about which said alternate pivotal movement occurs.

8. The propulsion device claimed in claim 7 wherein said second reciprocal frame is longer than said first reciprocal frame in order to produce said nested configuration and said torsional spring biasing means for said rearward foil is weaker than said torsional spring biasing means for said forward foil.

9. A method of propulsion comprising transversely reciprocating and pivoting a forward foil means about a pivotal point positioned less than the quarter chord point from the leading edge of said forward foil means; and alternately transversely reciprocating and pivoting a rearward foil means in a direction opposed to the alternate transverse reciprocation and pivoting of said forward foil means, said pivoting of said forward foil means and said rearward foil means occurring about axes which are substantially parallel; thereby producing a wake by the transversely reciprocating and pivoting of said forward foil means and increasing the resultant velocity component and the forward thrust produced by said transversely reciprocating and pivoting rearward foil means and producing a wake by said rearward foil means and increasing the resultant velocity component and the forward thrust of said transversely reciprocating and pivoting forward foil means.

10. The method of propulsion claimed in claim 9 further comprising biasing the pivoting of said forward foil means and said rearward foil means relative to a neutral plane defined by the parallel axes about which said forward and rearward foil means alternately pivot in opposed direction.

* * * * *